US009752780B2

(12) United States Patent
Jones et al.

(10) Patent No.: US 9,752,780 B2
(45) Date of Patent: Sep. 5, 2017

(54) ABRADABLE LINER FOR A GAS TURBINE ENGINE

(71) Applicant: ROLLS-ROYCE PLC, London (GB)

(72) Inventors: Simon Lloyd Jones, Bristol (GB); Kevin Paul Self, Bristol (GB); Mark John Simms, Bristol (GB)

(73) Assignee: ROLLS-ROYCE plc, London (GB)

( * ) Notice: Subject to any disclaimer, the term of this patent is extended or adjusted under 35 U.S.C. 154(b) by 465 days.

(21) Appl. No.: 14/309,698

(22) Filed: Jun. 19, 2014

(65) Prior Publication Data

US 2015/0000288 A1 Jan. 1, 2015

(30) Foreign Application Priority Data

Jun. 27, 2013 (GB) ..... 1311460.8

(51) Int. Cl.
*F23R 3/00* (2006.01)
*F01D 11/12* (2006.01)

(52) U.S. Cl.
CPC ..... *F23R 3/002* (2013.01); *F01D 11/122* (2013.01); *F01D 11/125* (2013.01); *F01D 11/127* (2013.01)

(58) Field of Classification Search
CPC ..... F01D 11/122
See application file for complete search history.

(56) References Cited

U.S. PATENT DOCUMENTS 3,365,172 A 1/1968 McDonough et al.
3,728,039 A 4/1973 Plemmons et al.
6,171,052 B1 1/2001 Aschenbruck et al.
6,644,914 B2 * 11/2003 Lawer ..... B23H 9/10 29/888.3
2003/0175116 A1 9/2003 Le Biez et al.
2005/0058541 A1 3/2005 Le Biez et al.
2008/0124214 A1 5/2008 Lutjen et al.

FOREIGN PATENT DOCUMENTS

EP 1413771 A1 4/2004
EP 1 985 808 A2 10/2008
EP 1985808 A2 10/2008
JP A-61-149506 7/1986
JP 2008-309051 A 12/2008

OTHER PUBLICATIONS

Oct. 29, 2014 Search Report issued in European Application No. 14 17 3092.
British Search Report issued in British Patent Application No. GB1311460.8 dated Jan. 17, 2014.

* cited by examiner

*Primary Examiner* — Kenneth Bomberg
*Assistant Examiner* — John S Hunter, Jr.
(74) *Attorney, Agent, or Firm* — Oliff PLC

(57) ABSTRACT

Described is an abradable component for a gas turbine engine that includes a base having an outboard side which receives a supply of cooling air in use and an inboard side with a plurality of walls thereon. The walls intersect one another to define an abradable network of open faced cells on a gas washed surface thereof, and at least one of the walls includes one or more through-holes for providing a flow of cooling air from the outboard side to the gas washed surface of the abradable network of open faced cells, when in use.

20 Claims, 3 Drawing Sheets

ABRADABLE LINER FOR A GAS TURBINE ENGINE

TECHNICAL FIELD OF INVENTION

This invention relates to an abradable component for a gas turbine engine. In particular, the invention relates to an abradable liner for a rotating turbine blade in a gas turbine engine.

BACKGROUND OF INVENTION

FIG. 1 shows a ducted fan gas turbine engine 10 comprising, in axial flow series: an air intake 12, a propulsive fan 14 having a plurality of fan blades 16, an intermediate pressure compressor 18, a high-pressure compressor 20, a combustor 22, a high-pressure turbine 24, an intermediate pressure turbine 26, a low-pressure turbine 28 and a core exhaust nozzle 30. A nacelle 32 generally surrounds the engine 10 and defines the intake 12, a bypass duct 34 and a bypass exhaust nozzle 36.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. The core flow enters in axial flow series the intermediate pressure compressor 18, high pressure compressor 20 and the combustor 22, where fuel is added to the compressed air and the mixture burnt. The hot combustion products expand through and drive the high, intermediate and low-pressure turbines 24, 26, 28 before being exhausted through the nozzle 30 to provide additional propulsive thrust. The high, intermediate and low-pressure turbines 24, 26, 28 respectively drive the high and intermediate pressure compressors 20, 18 and the fan 14 by interconnecting shafts 38, 40, 42 which are coaxially and concentrically arranged along a principal axis 31 of rotation for the engine 10.

It is well known that the efficiency of a gas turbine engine can be generally improved by closely controlling the gap between the various rotor blade tips and the engine casing so as to minimise the leakage of air over the blade tips. To this end, seal segments are located radially outwards of the turbine blades and provide the boundary of the main gas path. The seal segments often include an abradable liner which provides an adaptable and close fitting seal with the blade tips. The abradable seals are adaptable in that they preferentially wear when contacted by the blade tips such that the separating gap is determined by the blade tip position experienced in use. This allows the gap to be controlled to a working minimum without fear of damage to the blade tips.

One type of known abradable liner comprises a honeycombed structure in which a network of honeycomb shaped cells is presented radially outwards of the rotor blade tip path for abrasion. Such abradable honeycomb liners (or lands) often include a sintered powder coating within the honeycombs which helps provide increased oxidisation protection and a better seal with the blade tip. The sintered material is also less dense than the alternative metal of the seal segment honeycombs. However, the sintered powder coatings make it more difficult to provide effective cooling to the liner surface which can lead to increased oxidisation and premature degradation and wear of such liners.

Cooling schemes for abradable liners are known. For example, U.S. Pat. No. 3,365,172 describes a turbine shroud cooling scheme which provides cooling air through small holes which are registered with the openings in the honeycomb liner so as to provide cooling air to the gas washed surface of the shroud. However, this method precludes the use of a sinter powder coating and can result in a cooling regime which does not suit the e of the component.

The present invention seeks to provide an improved cooling arrangement for an abradable liner.

STATEMENTS OF INVENTION

In a first aspect, the present invention provides an abradable component for a gas turbine engine, comprising: a base having an outboard side which receives a supply of cooling air in use and a plurality of walls on an inboard side thereof, the walls adjoining one another to provide an abradable network of open faced cells at a gas washed surface thereof; wherein at least one wall includes one or more through-holes for providing a flow of cooling air from the outboard side to the gas washed surface of the abradable network of open faced cells, when in use.

Providing through-holes in the walls of the abradable surface allows cooling air to be delivered to the gas washed surface thereof. The through-holes may be blind holes prior to in use wear which abrades and exposes an open end of the blind hole to provide a through-hole.

The one or more through-holes may be positioned at an intersection of two or more walls. Alternatively or additionally the through-holes may be placed along a mid-portion of the walls.

The wall or intersection may include a boss through which the through-hole pass. The boss may be a cylindrical structure with a longitudinal axis which is coaxially aligned with the longitudinal axis of the through-hole.

The abradable line may further comprise one or more through-holes which outlet into one of the open faced cells.

The one or more through-holes may be provided at an outer edge of the network of cells.

The abradable component may further comprise at least one hole which extends from the base partially through the wall towards the open face of the cell so as to provide a blind hole which is arranged to be exposed after a predetermined amount of wear.

The one or more through-holes may have a uniform cross section along its length. The cross-section of the through-hole may change along the length of the through-hole. The through-hole may have a plurality of cross-sectional diameters along the length of the through-hole. The cross-sectional diameter of the through-hole may reduce continuously along the length of the through-hole. The through-hole may have a conical cross section along the length of the through-hole.

The open faced cells may be filled with an abradable material. The abradable material may be a sintered powder material.

The closed end of the one or more blind holes may be provided by an abradable material which is a different material to the at least one wall.

Two or more of the blind holes may have end walls of different thicknesses so as to be exposed after different amounts of wear.

DESCRIPTION OF DRAWINGS

Embodiments of the invention will now be described with the aid of the following drawings of which.

DETAILED DESCRIPTION OF INVENTION

Figure 1:
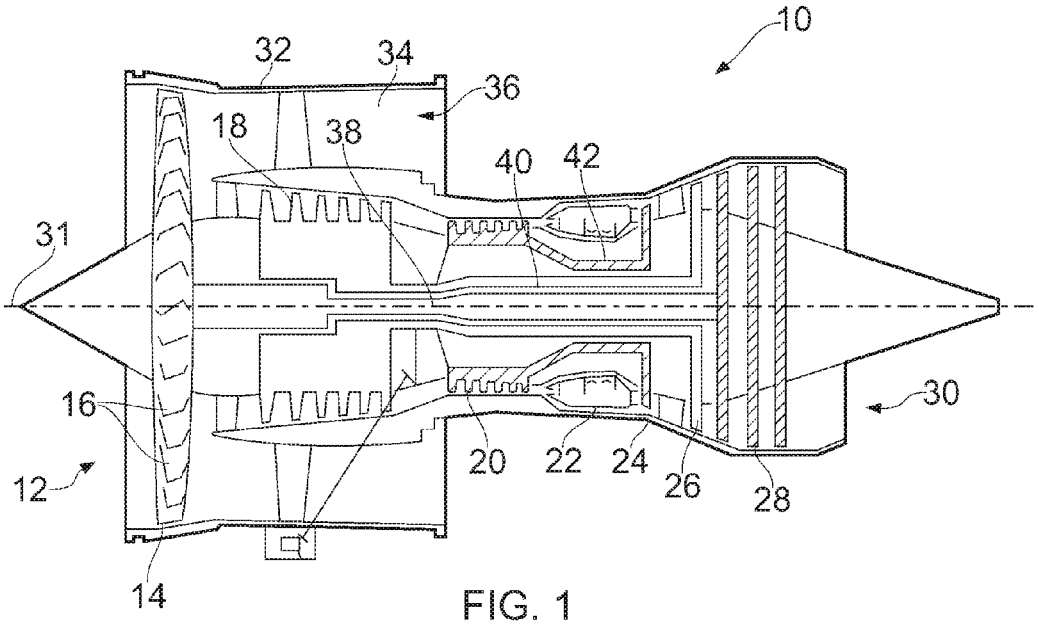
FIG. 1 shows a conventional gas turbine engine to which the invention can be applied.
Figure 2A:
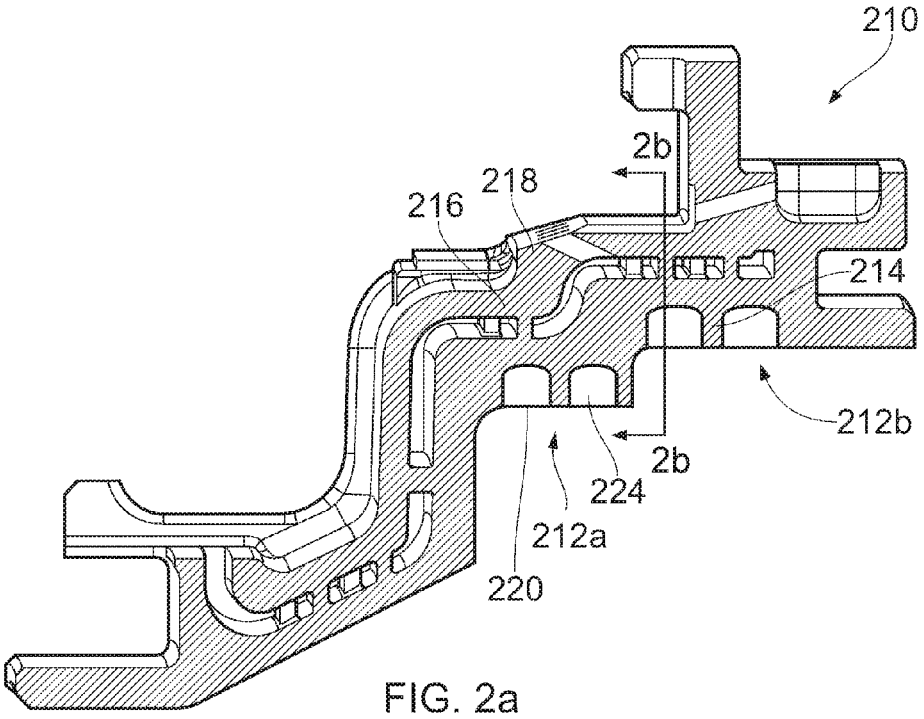
FIGS. 2*a* and 2*b* respectively show axial and circumferential cross sections of a seal segment according to the invention.
Figure 2B:
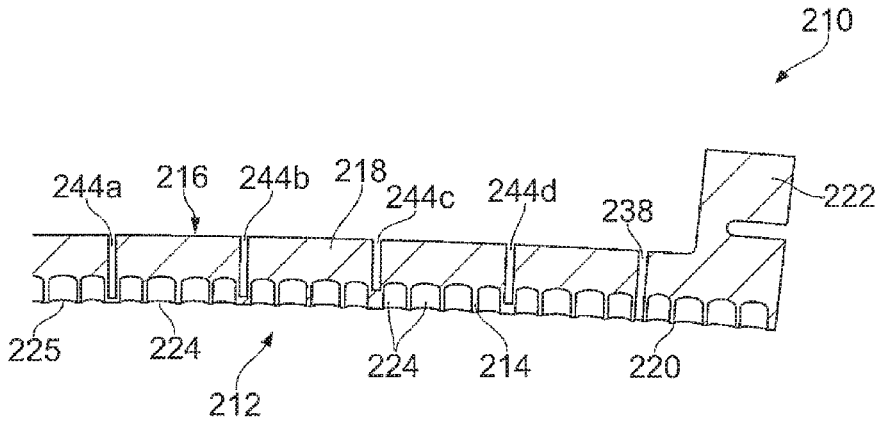

FIGS. 2*a* and 2*b* respectively show an axial and a circumferential cross-section of a seal segment 210 which forms part of a shroud arrangement when mounted in an engine similar to that shown in FIG. 1. The seal segment 210 is one of a plurality of similar arcuate seal segments which join to form an annular structure around a turbine rotor of the gas turbine engine 10 so as to define a portion of the main gas flow path through the gas turbine engine. The seal segment 210 is placed in a close fitting radially outward relationship to the rotor blade (not shown) so as to help reduce leakage of gas over the tips of the rotor blades and to contain the hot gas flow path of the respective turbine section.

In order to help minimise the separation of the seal segment 210 and the rotor blade, the seal segment 210 is provided with an abradable surface 212 in the form of a network of interconnected walls 214 which define and bound a plurality of open faced cells 224. The interconnecting walls 214 are provided: on a circumferentially extending arcuate backing plate 216 which provides structural support and stability and a means for mounting the seal segment 210 within the engine casing. The abradable surface is positioned relative to rotational path of the rotor blades so as to be selectively eroded by the blade tips during normal operation to allow as close a fit as possible. The wear experienced by the seal segment 210, so-called tip rub, occurs throughout the life of the turbine as the relative spacing of the rotor blade tip and seal segment change during service for various reasons.

These changes can be as a result of mechanical shock and vibration, changes in relative thermal and pressure conditions, and due to accumulative wear on the system as whole which results in a greater degree of deleterious relative movement.

As can best be seen in FIG. 2*a*, the seal segment 210 includes two axially extending abradable portions 212*a,b* which are held at different radial distances with respect to the principal axis 31 of the engine and are axially offset with one another so as to provide an upstream abradable portion 212*a* and a downstream abradable portion 212*b*. These two abradable portions 212*a,b* correspond to fins on the tips of the turbine blades (not shown) which cut into the abradable portions 212*a,b* when in use. For the purpose of the embodiment described here, the abradable portions 212*a,b* can be deemed to be the same. In some embodiments there may only be one abradable portion or the portions may be at a common radial distance from the principal axis 31.

The radially outer facing surface 218 of the plate 216 is outside of the main gas flow path of the turbine 10 and receives a flow of cooling air to cool the seal segment 210 when in use. The radially inner surface 220 of the plate 216 is located proximate to the main gas flow path of the turbine 10, thereby providing a gas washed surface which bounds and defines the main gas flow path within the turbine.

The backing plate 216 can either be a separate structure to which the abradable surface 212 is adhered, or integrally formed. A flange 222 for mating with an adjacent seal segment is included on one of the circumferential ends of the seal segment 210.

The radially inner facing surface 220 of the plate 216 is covered with a regular array of open faced cells 224 which provide the abradable surface against which the rotor blades can preferentially rub in use. The open face 226 of the cells 224 are polygonal in construction, specifically rhomboidal in the described embodiment, with the major axes 230 in axial alignment with the principal axis 31 of the gas turbine engine 10.

The open faced cells 224 are constructed from a plurality of walls 214 which project in a radially inward direction from the radially inward side of the plate 216 so as to extend toward the rotational path of the rotor when mounted in an engine 10. The walls 214 of the described embodiment extend in a direction which is generally perpendicular to face surface of the base 214, but they may be set at an angle to the plane of the plate in some embodiments.

To provide a more durable and preferentially abradable structure and to prevent oxidisation of the liner and associated deterioration during use, the open faced cells 224 are filled with an abradable material 225. In one embodiment, the abradable material is a sintered powder coating in the form of Nickel Aluminide. The powder is deposited so as to fill the open cells before being sintered and heat treated using known methods to produce the required mechanical properties.

Figure 3:
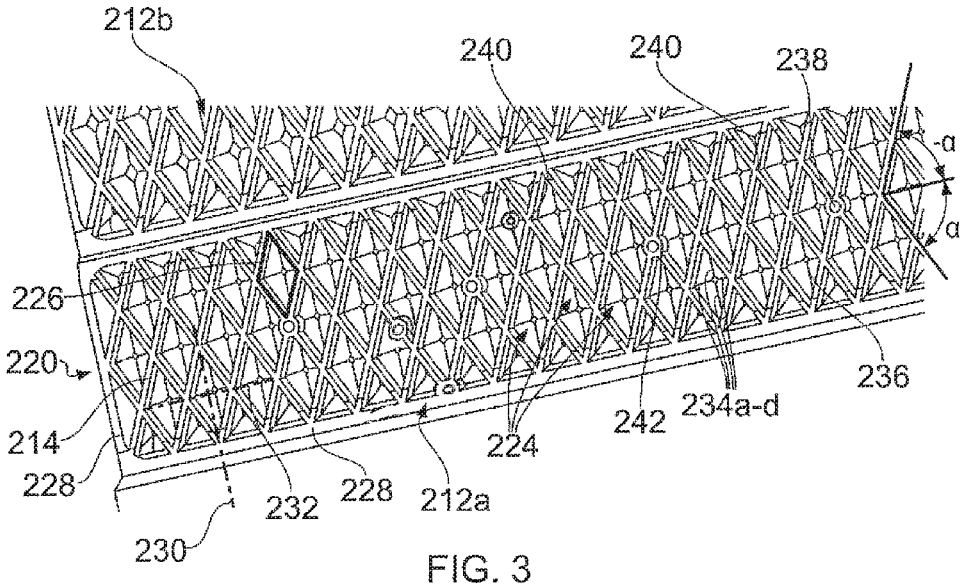
FIG. 3 shows a face view of the abradable structure.

FIG. 3 shows the arrangement of the abradable seal segment 210, from the gas washed side to show the interconnected walls 214 and open faced cells 222. It will be noted that the sintered powder coating has been omitted for the sake of clarity. The periphery of each abradable portion 212*a,b* is bounded by a boundary wall 228 which extends around the circumferential edge and defines a polygonal area in the form of a rectangle having a longitudinal axis which extends circumferentially around the rotor blade path when in use. The abradable walls 214 and open celled structures are located within the peripheral wall 228. It will be appreciated that the boundary wall may also form part of the abradable portion 212*a*.

The walls 214 which define the open faced cells 224 are generally straight and extend between the boundary walls 228 in a lattice work having junctions or interconnections 240 where the walls 214 intersect and cross. There are first and second linear arrays of abradable wall 214*a,b*, each of which include a plurality of parallel walls which are uniformly distributed along the circumferential length of the seal segment 210. Each abradable wall 214 within the first array is set at an angle $\alpha$ to a normal of the principal axis of the engine, with each wall of the second array being set at an angle $-\alpha$. Hence, the two arrays are arranged in opposing directions relative to the rotational axis of the engine 10 thereby providing a lattice work of interconnected walls 214 which define open faced cells 224 which are rhomboidal in shape at the open face 226. As such, each cell has a major axis 230 and a minor axis 232 which define two general planes of symmetry; one which extends along the rotational axis of the engine (major axis 230), the other being normal to the rotational axis (minor axis 232). The widths and heights of each wall 214 and the boundary walls 228 are substantially similar.

In the described embodiment of FIG. 3, the cells 222 are dimensioned so as to fit two end to end along the major axis 230 within the axial length of the boundary wall 228. It will be appreciated that the number of cells 224 across the circumferential length of each segment 210 will be dependent on the arcuate length of a particular segment 210.

The closed end of each open cell 224 is provided by the plate 216, which is shaped to provide four flats 234*a-d* which extend radially outwards from each of the walls 224 and converge towards a small rhomboidal base surface 236 in the centre of each cell 224. Thus, the closed end of the cells are provided with a faceted funnel-like shape having four flat sides which extend radially outwards from the rotational path into the plate 216.

The abradable seal segment 210 shown in FIG. 3 is provided with a number of cooling holes in the form of through-holes 238. The cooling holes are generally arranged so as to extend from the outboard side 218 of the seal segment 210 to the gas washed surface of the open-celled structures 224. The through-holes 238 are generally straight with a constant cross-section along the length of the hale and extend in a generally radial direction which is normal to the tangent of the outboard surface 218.

The through-holes 238 are selectively positioned at various intersections 240 of the walls 214 across the abradable surface 212 so as to provide cooling at preferential locations. In the described embodiment, the cooling holes 238 are provided along an axial mid-line which extends along the circumferential length of the abradable surface 212. Generally, the holes will be provided in the locations where tip rubs are more likely to occur and where oxidisation problems are more prevalent. In the case of a double land seal segment which has two axially extending abradable portions 212*a,b*, as shown in FIG. 2*a*, the upstream, hotter, portion will typically include a greater portion of cooling apertures.

The intersections 240 are provided with circular reinforcements in the form of the bosses 242 which are used to bound and define the through-holes 238. The bosses 242 are cylindrical structures with the holes bared there-through so as to be coaxially aligned with the longitudinal axis of the cylinder. The sidewalk are of uniform width and sufficient dimensions to allow the formation of the through-holes 238 during manufacture and to provide the necessary strength to prevent the through-holes 238 from collapsing during tip rubs. The bosses 234 shown in the described embodiment extend to the full height of the open faced cell 224, i.e. from a top planar surface of the walls near the gas washed surface to the base surface of the open faced cell 224 and coaxial with the intersections. However, it will be appreciated that the bosses may be provided along a mid-portion of a wall, or within the walls so as to be located within a cell 224 where necessary.

In one example of the described embodiment, the bosses 242 having an outer diameter of 1.5 mm with a through-hole 238 of diameter 0.7 mm. It is reasonable in some embodiments to have boss 234 and through-hole 232 diameters having a range of dimensions.

The base 216, walls 214 and bosses 242 are machined out of a homogeneous plate of metal such as single crystal nickel superalloy or a suitable high temperature equiax material. The skilled person will be aware of manufacturing techniques for forming the plurality of walls 214 by wire cutting, and forming the open faced cells 222 by electro discharge machining using electrodes.

The through-holes 238 provided in the bosses 242 are preferentially drilled from the outboard side of the plate 216. This is done after the application of the sintered powder coating for the through-holes 238.

Returning to FIG. 2*b*, the cooling holes may not be through-holes which pass entirely through the seal segment, but may be blind holes 244*a-d*. The blind holes 244*a-d* are drilled into the outboard side 218 of the seal segment 210 towards the gas washed surface at different partial depths. The depths of the holes are predetermined such that the closed end is removed with wear from the blade tip, to the point where the holes are exposed to the gas washed surface. Thus, the flow of cooling air provided to the inboard surface of the seal segment 210 can be progressively increased as the abradable liner wears and oxidisation increases.

In one embodiment, the area between the closed end of the blind holes 244*a-d* and the gas washed surface 240 is provided with abradable material. In other embodiments the area between the closed end of the blind holes 244*a-d* and the gas washed surface can be provided with a metallic material or a mixture of abradable material and metallic material.

The abradable portions may include one or more through—238 or blind-hole 244*a-d* at alternative locations. For example, cooling apertures may be placed along the length of the abradable walls 214 and not at the intersections 240. Cooling apertures may also be placed within walls 214 of the open-faced cells 224 so as to pass through the base and exit into the open cell 224. Hence, the plurality of walls 214 can contain a series of through—238 or blind-holes 244*a-d* at an intersection 240 of at least two walls 214, and have a series of through holes 238 positioned within the open faced cells 224. The distribution of the cooling holes 238 can vary upon size of seal segment 210 and operating environment of the gas turbine engine 10.

The through—238 and blind-holes 244*a-d* can also be adapted in some embodiments to provide erosion dependant cooling apertures in which the cross-sectional profile of the cooling hole changes, either continuously or discretely, as wear progresses. Hence, there can be a plurality of cross sectional diameters along the length of the hole such that the minimum restriction can increase in accordance with predetermined levels of wear. In this way, the cooling flow can be adapted during the operational lifecycle of the engine 10.

Figure 4:
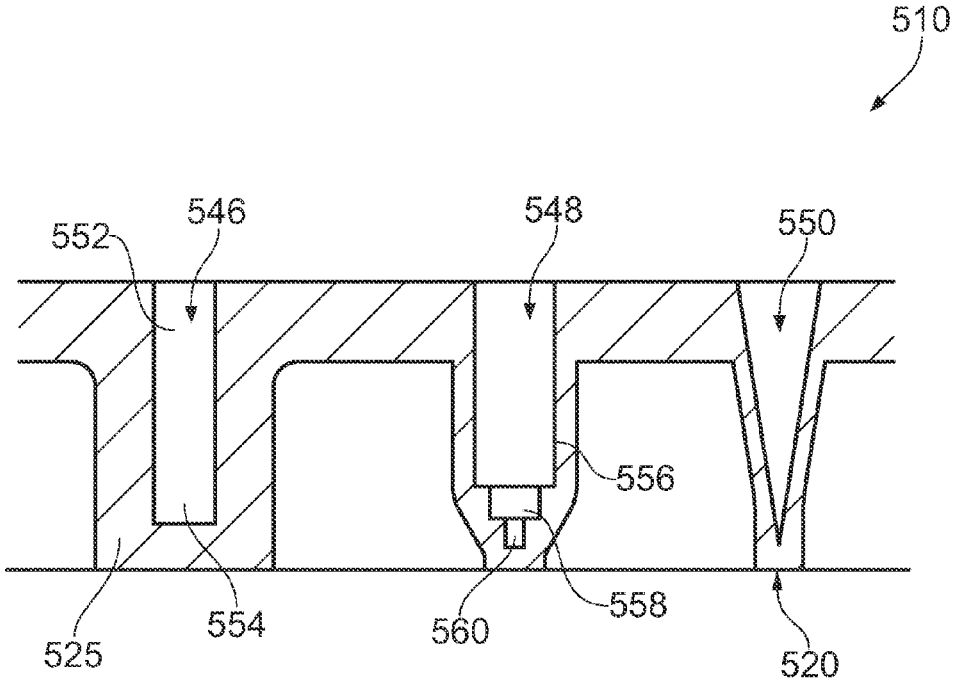
FIG. 4 shows alternative cooling hole profiles.

FIG. 4 shows three different cooling hole 546, 548, 550 configurations of the blind type which have been drilled into a boss 525. The holes are such that the flow area alters along the length of the holes as the seal segment is worn from the inboard surface 520. The abradable seal segment 510 can include any combination of these profiles, and any other which may be advantageous for a given application.

The first hole 546 is a blind hole having a uniform cross-sectional area along the length of the hole from an open outboard end 552 to the radially inner closed, or blind, end 554. The diameter of the hale 546 will be dependent on the required cooling and the expected available cooling air. The frangibility and particle size of the abraded material 525 may also be a consideration in the sizing of a cooling hole 546 to help prevent a blockage during use.

The second configuration of hole 548 has a cross-sectional area that changes along the length of the hole. The change in cross-sectional area is provided by a radially stepped portion which defines a boundary between portions of hole having different diameters. Thus, the stepped hole 548 has a first portion 556 with a first cross-sectional flow area or diameter, a second portion 558 with a second cross-sectional flow area or diameter, and a third portion 560 having a third cross-sectional area or diameter. The first 556, second 558 and third 560 portions are co-axially aligned with the cross-sectional flow areas decreasing as the hole extends from the outboard side. Thus, in use, the larger cross-sectional flow areas become exposed after increasing amounts of wear so as to increase the cooling in the local vicinity.

The transition between the two (or more portions of differing cooling flow area) can be provided by a discrete change in flow area, such as the step as shown, or may include one or more convergent portions which provide a graduated reduction in the flow area between portions.

The third configuration of hole 550 has a cross-sectional flow area which changes continuously along the length of the hole 560 so as to converge at a constant rate towards the gas flow surface. Thus, during use and the progressive wear, the hole gradually increases in proportion to the amount of tip wear at any given time.

It will be appreciated that any suitable profile of hole could be used within the scope of the invention and as required per a particular application.

It wily also be appreciated that the thickness of the hole walls can be tailored so as to provide a different profile to that of the drilled holes. This can be seen in the second 548 and third 550 holes of FIG. 4, where the wall profile which defines the outer wall of the sintered powder structures is different to the hole profile.

The distribution of the holes across the surface of the abradable structures and the corresponding depths of the blind holes will largely be decided by the application. Further, there may be some embodiments which will have only blind holes. Other embodiments may have only through-holes. The blind end of the blind holes may be provided by a different material to the honeycomb material. The blind end may be provided with the sintered powdered material.

The above described embodiments are examples of the invention which is defined by the appended claims. The examples should not be taken to limit the scope of the claims.

The invention claimed is:

1. An abradable component for a gas turbine engine, comprising:

a base having an outboard side which receives a supply of cooling air in use and an inboard side with a plurality of walls thereon, the walls intersecting one another to define an abradable network of open faced cells on a gas washed surface thereof, wherein at least one of the walls includes one or more through-holes for providing a flow of cooling air from the outboard side to the gas washed surface of the abradable network of open faced cells, when in use, and wherein one of the walls or an intersection at which two or more of the walls intersect one another includes a boss through which one of the one or more through-holes passes.

2. An abradable component for a gas turbine engine as claimed in claim 1, wherein the one or more through-holes are positioned at an intersection of two or more of the walls.

3. An abradable component for a gas turbine engine according to claim 1, wherein at least one of the one or more through-holes outlet into one of the open faced cells.

4. An abradable component for a gas turbine engine according to claim 1, wherein the one or more through-holes are provided at an outer edge of the network of open faced cells.

5. An abradable component for a gas turbine engine according to claim 1, wherein the one or more through-holes have a uniform cross section along their lengths.

6. An abradable component for a gas turbine engine according to claim 1, wherein the cross-section of one of the one or more through-holes changes along the length of the one through-hole.

7. An abradable component for a gas turbine engine according to claim 6, wherein cross-sectional diameter of the one through-hole reduces continuously along the length of the one through-hole.

8. An abradable component for a gas turbine engine according to claim 1, wherein one of the one or more through-holes has a plurality of sections along its length, each section having uniform cross-sectional areas along the length of the section.

9. An abradable component for a gas turbine engine according to claim 1, wherein the walls intersect one another to provide a lattice work of walls.

10. An abradable component for a gas turbine engine according to claim 9, wherein the lattice work comprises a first and a second linear array of elongated walls.

11. An abradable component for a gas turbine engine according to claim 1, wherein the boss is cylindrical.

12. An abradable component for a gas turbine engine according to claim 1, wherein the one or more through-holes have central axes normal to a tangent of the inboard surface.

13. An abradable component for a gas turbine engine according to claim 1, wherein the gas washed surface is arcuate and the walls are provided on the arcuate, gas washed surface.

14. An abradable component for a gas turbine engine, comprising:

a base having an outboard side which receives a supply of cooling air in use and an inboard side with a plurality of walls thereon, the walls intersecting one another to define an abradable network of open faced cells on a gas washed surface thereof, wherein at least one of the walls includes one or more through-holes for providing a flow of cooling air from the outboard side to the gas washed surface of the abradable network of open faced cells, when in use, and wherein the abradable component further comprises at least one hole which extends from the base partially through one of the walls towards the open face of one of the open faced cells so as to provide a blind hole which is arranged to be exposed after a predetermined amount of wear.

15. An abradable component for a gas turbine engine according to claim 14, wherein a closed end of the blind hole is provided by an abradable material which is a different material to that constituting the plurality of walls.

16. An abradable component for a gas turbine engine according to claim 14, comprising two or more blind holes having end walls of different thicknesses so as to be exposed after different amounts of wear.

17. An abradable component for a gas turbine engine, comprising:

a base having an outboard side which receives a supply of cooling air in use and an inboard side with a plurality of walls thereon, the walls intersecting one another to define an abradable network of open faced cells on a gas washed surface thereof, wherein at least one of the walls includes one or more through-holes for providing a flow of cooling air from the outboard side to the gas washed surface of the abradable network of open faced cells, when in use, and wherein the open faced cells are filled with an abradable material.

18. An abradable component for a gas turbine engine according to claim 17, wherein the abradable material is a sintered powder material.

19. An abradable component for a gas turbine engine according to claim 17, wherein one of the walls or an intersection at which two or more of the walls intersect one another includes a boss through which one of the one or more through-holes passes.

20. An abradable component for a gas turbine engine according to claim 17, further comprising at least one hole which extends from the base partially through one of the walls towards the open face of one of the open faced cells so as to provide a blind hole which is arranged to be exposed after a predetermined amount of wear.

* * * * *